United States Patent [19]

Osta et al.

[11] Patent Number: 4,465,015

[45] Date of Patent: Aug. 14, 1984

[54] DEVICE FOR SPREADING A SUBSTANCE ONTO A MOVING WEB OF MATERIAL

[76] Inventors: Francesco Osta, Tenuta Avallano, 1-15039, Ozzano Monferrato; Giuseppe Cattane, Vorso Manacorda 45, 1-15033, Casale Monferrato, both of Italy

[21] Appl. No.: 477,734

[22] Filed: Mar. 21, 1983

[30] Foreign Application Priority Data

Apr. 5, 1982 [IT] Italy ..... 67442 A/82

[51] Int. Cl.[3] ..... B05C 1/08; B05C 1/16

[52] U.S. Cl. ..... 118/222; 118/249; 118/259; 118/414

[58] Field of Search ..... 118/249, 262, 259, 248, 118/258, 244, DIG. 15, 221, 222, 224, 212, 410, 411, 412, 414, 216; 427/286; 425/376 R, 376 A, 376 B, 379 R, 466, 467

[56] References Cited

U.S. PATENT DOCUMENTS

| | | | |
|---|---|---|---|
| 2,875,728 | 3/1959 | Kasak | 118/410 |
| 3,818,861 | 6/1974 | Turner | 118/221 |
| 3,980,043 | 9/1976 | Pomper | 118/414 |
| 4,051,807 | 10/1977 | Graf et al. | 118/410 |
| 4,055,389 | 10/1977 | Hayward | 425/466 |
| 4,263,870 | 4/1981 | Saito et al. | 118/259 |
| 4,293,517 | 10/1981 | Knox | 425/467 |

*Primary Examiner*—Michael R. Lusignan
*Assistant Examiner*—Robert J. Steinberger, Jr.
*Attorney, Agent, or Firm*—Young & Thompson

[57] ABSTRACT

A device for spreading a substance onto a moving web of material, which comprises an extrusion head and a rotating bar which is carried by a support member applied to the extrusion head near the outlet of a delivery slit. This latter has an inner profiled recess in which engage limiting blade segments which extend up to the outlet of the delivery slit in order to laterally limit the regions in which spreading is carried out. The rotating bar has its outer surface operatively contacting the web only in the regions in which the substance is spread, and it is recessed or interrupted where no spreading is wanted. This device allows to spread a substance onto a width of web reduced with respect to the width of the extrusion head, or even onto separate strips of the web.

14 Claims, 8 Drawing Figures

DEVICE FOR SPREADING A SUBSTANCE ONTO A MOVING WEB OF MATERIAL

BACKGROUND OF THE INVENTION

This invention relates to a device for spreading a substance onto a moving web of material supported by a roller, comprising a rotating bar in contact with the web material opposite to said roller, and an extrusion head having a delivery slit for supplying to said rotating bar the substance to be spread.

In the known devices of this type, the means for supplying the substance to be spread is formed by an extrusion head having a delivery slit, and the rotating bar is mounted inside the extrustion head itself within the outlet of the delivery slit. With such a construction, the spreading takes place, usually, over a width corresponding to the full extent of the rotating bar and the extrusion head. To modify the spreading width it is necessary to insert limiting members so shaped as to conform to the surface of the bar in order to provide a seal both in the delivery slit and against the bar inserted therein. This gives rise to a dangerous friction, but above all the operation of inserting such limiting members is long and difficult to carry out, especially when the work is accomplished at high temperatures, such as 200°–300° C., and the results are not always satisfactory. In the concerned devices it is not possible to use the customary limiting lists supported by outer list holders, which are used in the direct extrusion heads to partially occlude the delivery slit. Moreover, in devices of this kind, even in those cases in which an effective delimitation of the delivery slit could be carried out, in general it would still be necessary to mount a web support roller whose operative surface has a width exactly corresponding to the width of the web, in order to avoid any harmful direct dry friction contact between the rotating bar and the roller. Therefore, to pass from the spreading of a substance on a web of a given width to the spreading of a substance on a web of a different width it would be necessary to replace the former roller with a new roller having different characteristics, which involves the necessity of having available a set of highly expensive and bulky rollers, as well as a relatively long and difficult operation for converting the equipment.

BRIEF SUMMARY OF THE INVENTION

The main object of this invention is to provide a spreader device of the general type described hereinabove, which is suitable for carrying out the spreading on an adjustable width, by a relatively brief and easy operation, and without requiring the availability of expensive sets of component parts.

This object is attained according to the invention, by the fact that:

the rotating bar is supported by a separate support member applied to the extrusion head near the outlet of the delivery slit;

the delivery slit has, upstream its outlet portion, a profiled recess extending over the entire width of the extrusion head parallel to the outlet of the delivery slit;

in the regions in which no spreading has to be carried out, into the delivery slit there are inserted segments of a limiting blade having a thickness corresponding to the opening of the delivery slit and a height corresponding to the distance between said recess and the outlet of the delivery slit, and which terminates at the inner end in a head whose profile corresponds at least in part to the profile of said recess; and the operative surface of said rotating bar is limited to the zones in which the spreading has to be carried out, the remaining portions of the bar being recessed or removed.

Since the rotating bar is mounted near the outlet of the delivery slit of the extrusion head instead of being mounted within said outlet, its presence does not interfere with the insertion of limiting means into the delivery slit. The limiting means, formed by blade segments which exactly fill up the outlet portion of the delivery slit up to the outer surface of the extrusion head, allow a precise delimitation of the zones delivering the substance to be spread, which zones may therefore be made to correspond to the desired spreading width. The presence of the head of the blade, inserted into the corresponding recess of the delivery slit, allows the limiting blade segments to withstand the extrusion pressure and to provide an effective closure of the zones in which no spreading has to take place. Finally, the limitation of the operative surface of the bar to the sole zones in which the spreading has to take place prevents any direct dry friction contact between the rotating bar and the roller supporting the web material, so that the roller, having a width corresponding to the whole width of the extrusion head, does not require replacement or modification to work in a correct manner on partial widths.

In this way, to adapt the device for carrying out a spreading operation on a width smaller than that of the extrusion head, it is sufficient to insert limiting blade segments into the delivery slit over a suitable extent beginning from the ends of the extrusion head, and to mount on the support member a rotating bar whose operative surface corresponds to the desired spreading width. These operations can be carried out easily and quickly and thus avoid long times of machine shutdown. The provision of the set of rotating bars necessary for the various required modalities of operation involves storage and capital tie up problems which are much less serious than those involved by the provision of a corresponding set of rollers. In addition, by a suitable arrangement of the limitation blade segments and a corresponding configuration of the operative surface of the rotating bar it becomes also possible to carry out a spreading on alternate zones, i.e. a striped spreading on the web material, without introducing any harmful dry friction of portions of the rotating bar on the web material in the zones having no substance spread thereon.

Mounting the rotating bar in a support member separate from the extrusion head and applied thereon gives the possibility to carry out in an independent manner the adjustment of the delivery slit and of the rotating bar, and it also makes possible to add means for rendering the rotating bar perfectly parallel relative to the facing generatrix of the web supporting roller, by compensating for the elastic deformation cambers due to the weight of the parts and to the forces being exerted. Thereby is ensured an exact uniformity of the thickness of the layer of substance spread onto the web material and hence also it is allowed to reduce said thickness to the minimum allowable values, with resulting reduction in the consumption of substance to be spread.

BRIEF DESCRIPTION OF THE DRAWINGS

These and other features of the invention will be more clearly apparent from the following description of some embodiments given by way of non limiting examples, diagrammatically shown in the accompanying drawings, in which.

DETAILED DESCRIPTION OF PREFERRED EMBODIMENTS

Figure 1:
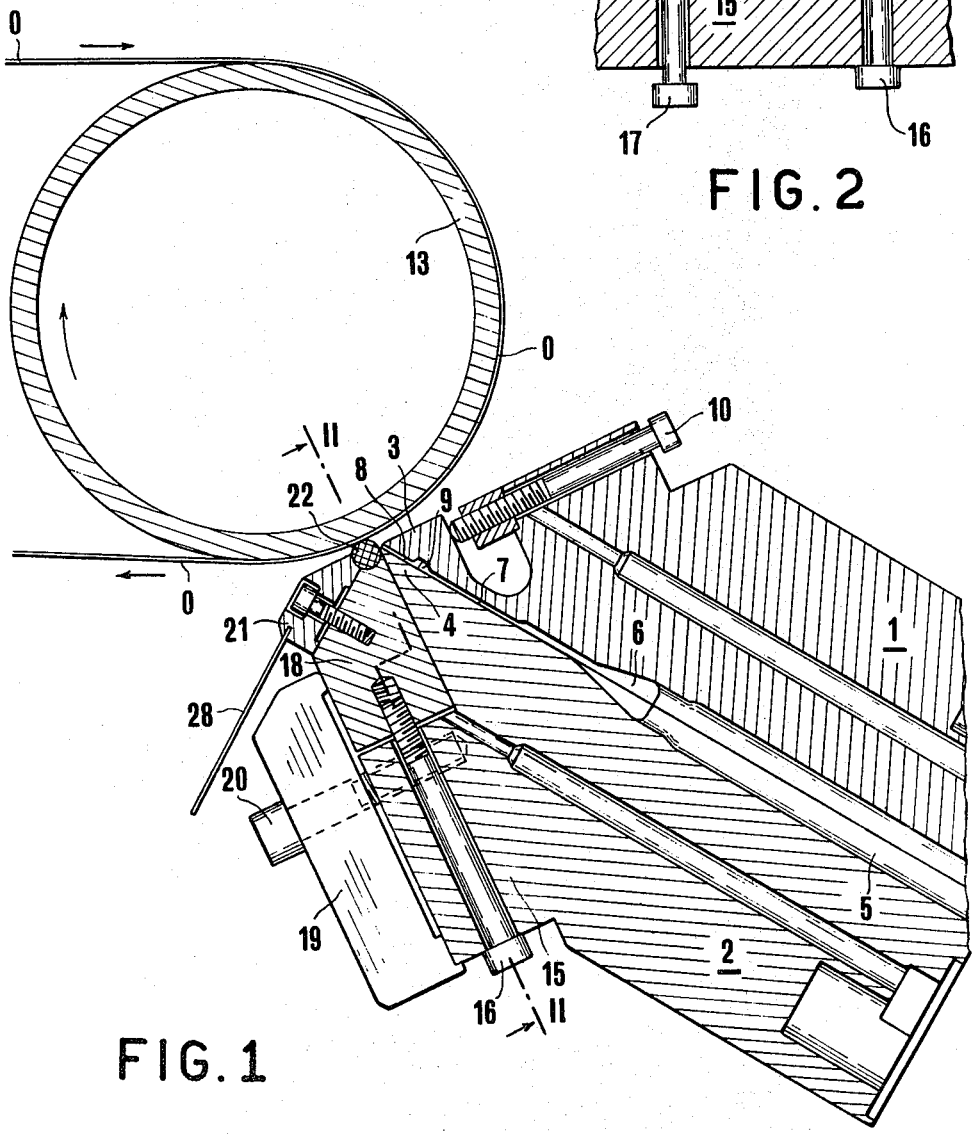
FIG. 1 is a sectional view of a spreader device shown on a small scale.
Figure 4:
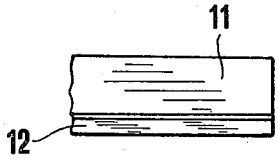
FIG. 4 is a front view showing a limiting blade segment.

The spreader device shown in FIG. 1 comprises an extrusion head formed by two adjacent parts 1 and 2, each of which extends to form an extrusion lip 3 and 4, respectively, which in the present case is integral with the parts of the head, but could also be separate and applied thereon in a known manner. Formed between the parts 1 and 2 of the head is a feeding circuit 5 intended to be supplied, by an extruder or a pump, not shown, with the substance to be spread which is molten by heat or is fluid at the ambient temperature. The feeding conduit 5 opens into a collector 6 which extends over the whole width of the head 1–2 and from which a delivery slit 7 departs which extends, up to the outlet portion 8, between the two extrusion lips 3 and 4, one of which, indicated by reference numeral 3, is flexible. The opening degree of the delivery slit 7 can be adjusted by means of screws 10 screwed into the body 1 of the head and acting on the lip 3 which can be flexibly deformed. The outlet 8 of the delivery slit 7 is situated facing a hollow roller 13, on which passes and is supported the web 0 onto which a thin layer of the substance supplied through the conduit 5 has to be spread. The web 0 moves at a speed which may be, for example, from 30 to 500 meters/minute. The roller 13 may be refrigerated or even slightly heated and regulated by a thermostat, according to the operative requirements. Generally it is coated in a known manner with silicone rubber or another material having a limited deformability, for example with a hardness from 80 to 95 Shore.

Figure 3:
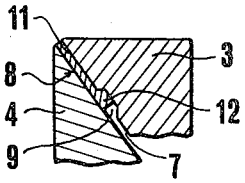
FIG. 3 is an enlarged view showing a detail of the cross section of the extrusion head with a limiting blade segment inserted into the delivery slit.

As shown more in detail in FIG. 3, the delivery slit 7, immediately upstream of its outlet portion 8, expands into a profiled recess 9 which extends over the entire width of the extrusion head.

The limitation of the operative width of the extrusion head is obtained by inserting into the outlet portion 8 of the extrusion slit 7 some segments of a limiting blade 11 whose thickness corresponds to the desired degree of opening of the delivery slit and which terminates at the inner end with a head 12 arranged to occupy a portion of the recess 9 of delivery slit 7. The segments of the blade 11 are inserted, beginning from the ends, into those portions of the delivery slit 7 which are intended to be neutralized in respect of the spreading, leaving free a central zone whose width corresponds to the spreading width to be obtained. Thus, the head 12 of each segment of the blade 11 occludes the recess 9 in the corresponding portions of the delivery slit 7, thus providing an efficient seal which is adapted to withstand the pressure of the molten substance supplied by the extruder or by the pump, without requiring any external support means. Moreover, the blade 11 occupies the corresponding outlet portions 8 of the delivery slit 7 pressed by the screws 10, thereby correctly delimiting up to the outlet the active portion of the delivery slit and ensuring a precise and effective side seal.

Thanks to the fact that the limiting means do not give rise to any protrusion beyond the outlet of the delivery slit, the outlet may be located adjacent a spreading bar contacting the web 0 and made to rotate in a direction conforming with the movement of the web, in order to receive the substance coming out from the delivery slit and to transfer it onto the web. In this arrangement, the distance between the outlet of the delivery slit and the point of application of the substance onto the web may vary according to the diameter of the rotating bar and the way this latter is disposed, and may thus be selected, for example, within the range from 4 to 15 mm. This distance has a considerable importance for the good operation of the device, because it allows a stretching of the substance to be spread and, accordingly, an adequate reduction of its thickness from the value corresponding to the width of the delivery slit to an adequately lower value.

To support the rotating bar 22, the extrusion head has a protruding portion 15 (which in other embodiments could be structurally separate from the head and fixed thereon) to which, by means of alternate traction and pressure screws 16 and 17, respectively, is connected a block 18 which can be locked by means of brackets 19 connected to the body 2 of the head by means of screws 20. Block 18, together with a retainer block 21 applied thereon, forms a seat for a bar 22 provided with means for keeping it rotating, of which an actuation mandrel 29 is diagrammatically shown in FIG. 5. By means of the traction and pressure screws 16 and 17, respectively, the block 18 and consequently the bar 22 can be adjusted exactly in their position, and furthermore there may be imposed thereon a flexural deformation. This imposed deformation allows to compensate for the elastic deformation cambers due to their own weight and to the forces being applied, which cambers may amount to some tenths of a millimeter, depending on the width of the extrusion head which may range, for example, from 300 to 3000 mm. Such cambers are large relative to the thickness, for example from 5 to 20 microns, of the layer of substance to be applied.

The adjusted position of block 18 and rotating bar 22 is fixed by tightening the screws 20 and, consequently, the brackets 19.

The said adjustment is carried out in such a manner that the rotating bar 22 will rest in a more suitable manner on the web 0 supported by the roller 13, which web is intended to receive a thin layer of the extruded substance coming out from the delivery slit. The applied substance is thus spread immediately on the web 0, with the possibility of obtaining an optimal uniformity of the thickness even when working on large widths. It is to be noted that the application of such a bar immediately downstream of the outlet of the delivery slit would not be possible in the known extrusion heads of variable operative width, in which the list holders give rise to a considerable protrusion at the inactive portions of the outlet of the delivery slit. Bar 22 is maintained in rotation by means 29 in the direction (counter-clockwise in FIG. 1) which conveys towards the web 0 the substance coming out from the outlet 8 of the delivery slit 7.

The bar is driven at a tangential speed which is much lower than the speed of the roller 13 and the web 0, for example from 1:10 to 1:100 of said speed, so that when passing from the surface of the bar to the surface of the web the applied substance is stretched into a very thin layer. This difference in tangential speed originates the problem that, should the spreading be carried out on a web 0 whose width is smaller than the extent of the bar 22 and of the roller 13, and should the web 0 be thin, in the side portions not involved in the spreading there would take place a direct dry friction between the bar 22 and roller 13, which would damage the respective surfaces and would give rise to a waste of energy and consequent heating.

It would thus be necessary to mount each time a roller 13 having a width limited to the zone on which the spreading is carried out, at least as regards the active surface of the roller, and replace the roller every time the work has to be done on a different width. This would be prohibitive both because of the cost and the encumbrance of a roller set adapted to each different working width, and because of the time required for and the complexity of the operations connected with the substitution of the roller.

Figure 5:
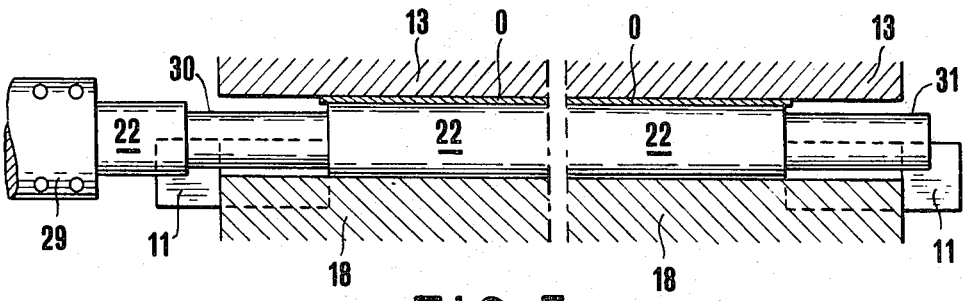
FIG. 5 is an enlarged view showing a detail of the cross section of the device in the region of the rotating bar.

Instead, according to a characteristic of the invention, the bar 22, as shown in FIG. 5, is formed in such a way as to have its active surface limited to the zones in which the spreading is carried out. According to FIG. 5, the remaining zones 30, 31 of the surface of the bar are recessed so that they do not contact the facing roller 13. As it can be seen in FIG. 5, the points of transition from the operative surface 22 to the nonoperative surfaces 30 and 31 of the bar correspond to the limits of the segments of blade 11 inserted into the adjacent outlet 8 of the delivery slit 7, so that the extruded substance is delivered exclusively in the region of the operative surfaces 22 of the bar and is conveyed onto web 0 supported by the roller 13. This latter cannot come into contact with the nonoperative portions of the bar, because of their being recessed, and no harmful contact condition can arise, in spite of the roller 13 having a width corresponding to the full width of the extrusion head.

The difference in height of the portions 30 and 31 relative to the operative surface of the bar 22 must be such as to prevent the contact of the bar with the roller 13, and therefore it depends mainly on the thickness of the web material 0, on the surface hardness of the coating of the roller 13 and on the diameter of the bar 22. Indicatively it may be said that with a bar having a diameter from 10 to 20 mm, with a surface hardness of the roller of nearly 90 shore and when working on a film having a thickness from 10 to 20 microns, the level difference of the nonoperative to the operative portions of the bar may range from 0.3 to 1 mm. It is pointed out that bars 22 having recessed portions could not be installed in known devices, i.e. directly in the outlet of the delivery slit of the extrusion head, because in this case the substance delivered would flow in uncontrolled manner between the seating for the bar and the recessed bar portions, thus rendering impossible the operation of the device.

It is to be understood that in the practice of the invention the bar 22 must be replaced with another in which the recessed portions are disposed in a different manner or are of a different extent, when changing the width on which the spreading is carried out, i.e. when modifying the position of the limiting blades 11 in the delivery slit. However, keeping in stock a set of bars 22 represents an encumbrance and a burden which are much smaller than those of keeping a set of rollers 13, and in addition the replacement of the bar 22 is much easier and quicker than that of the roller 13 and therefore it requires a much shorter machine shutdown.

Figure 6:
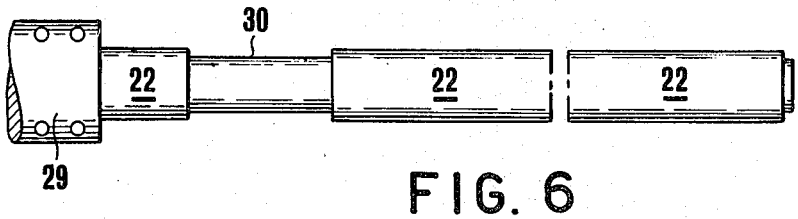
FIGS. 6 and 7 show modified embodiments of the rotating bar used in the device of FIG. 5.

While the recessed portion 30 of the bar according to FIG. 5 is necessary for connecting the bar to the actuation mandrel 29, on the contrary the recessed portion 31 is inactive and may be omitted, as shown in FIG. 6. This may be of interest because the bar 22 must be manufactured from special steels or subjected to secial treatments, for example nitriding, which render them relatively expensive, so that it is interesting to reduce the bars 22 to their minimum possible length.

Figure 7:
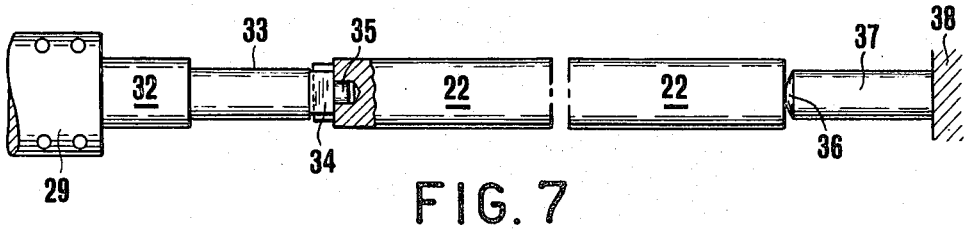

According to a further development of this concept, the bar 22 may be reduced to the length alone of its operative portion, as shown in FIG. 7. In this case, a connection bar 32 is connected to the operating mandrel and extends with a recessed portion 33 up to coupling means engaged in an end of the bar 22; the coupling means may consist of a flattened or prismatic portion 34 of the connection bar 32, inserted into a corresponding cavity of the bar 22, and of a centering pin 35. Thus, the connection bar 32 acts as a driving shaft for the bar 22. The opposite end of the bar 22 bears against the convex end 36 of a spacer bar 37 resting at the outer end against a fixed member 38. Spacer bar 37 does not rotate and has only the junction of ensuring the correct axial position of the spreading bar 22.

Figure 8:
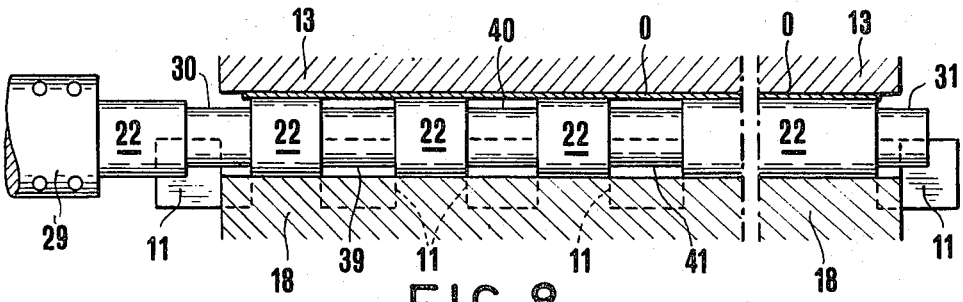
FIG. 8 is a sectional view similar to that to FIG. 5, concerning a device adapted for striped spreading.

A further development of the above concepts allows carrying out, by means of the device of the invention, a spreading of separate strips. In this case, as shown in FIG. 8, the bar 22 has a plurality of operative portions separated from each other by intermediate recessed portions 39, 40, 41 in addition to the recessed end portions 30 and 31. In a position corresponding to each recessed portion of the bar, a blade segment 11 is inserted into the delivery slit 7 of the extrusion head. As can be appreciated, this arrangement, which is not conceivable in the known devices, generates a delivery and spreading of the extruded substance along separate strips of the web 0.

This arrangement can be used either for spreading along strip zones separated from each other by zones having no substance spread thereon, on a single web 0, or to carry out the spreading simultaneously on plural webs of reduced width, disposed side by side.

Obviously, the arrangements according to FIGS. 6 and 7, intended to reduce the cost of the bar 22, can be used also in the case of a bar 22 having a plurality of intermediate recessed portions 39, 40, 41 according to FIG. 8.

The device according to this invention can be used both under heat up to temperatures of the order of 330° C., for spreading molten substances, and at ambient temperature for spreading substances whose viscosity is such as not to require melting them for carrying out the spreading.

In the embodiment shown, the extrusion head is turned towards the roller, on which the web moves, with its main (longitudinal) direction inclined by about 30° below the horizontal, which arrangement has proved in many cases to be the most suitable. However, it is to be understood that the inclination of the extrusion head way be modified, for example witin the range from 15° to 45°, according to the viscosity of the substance to be spread and according to the installation requirements and the characteristics of other members of the spreading unit.

Figure 2:
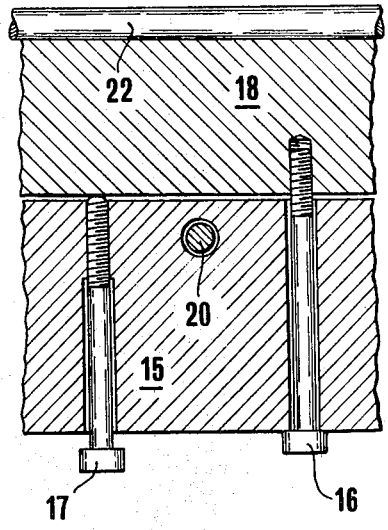
FIG. 2 is a partial sectional view thereof taken along line II—II of FIG. 1.

The inclination of the spreading head is particularly advantageous in the hot working process, because in case of interruption of the work it is possible to lift the roller 13 together with the web 0, to adjust to the minimum value the speed of the bar 22 and to reduce to a minimum the delivery of the substance to be spread, which then continues to be delivered in small quantity, and removed by the bar, draining then along the block 21, without standing within the device, which would give rise to decompositions and cloggings. In view of such event it is advantageous to fix to the block 21 over all the width of the extrusion head a shield plate 28, as shown in FIG. 2, to guide the outcoming substance out of the area of the parts connected to the extrusion head and to allow collecting it in a basin, without soiling.

We claim:

1. In a machine for the treatment of a moving web of material, comprising a support roller supporting said web, a device for spreading a substance onto said moving web of material, comprising:

an extrusion head arranged near said web opposite said support roller;

in said extrusion head a delivery slit for supplying the substance to be spread, said delivery slit having an outlet facing said web;

in said delivery slit a profiled recess arranged at a predetermined distance from said outlet and extending in parallel relationship with said outlet over the entire width of said extrusion head;

limiting blade segments inserted into said delivery slit in predetermined regions thereof in register with regions of the device in which no spreading is wanted, said limiting blade segments having a thickness corresponding to the thickness of said delivery slit and a height corresponding to the distance between said profiled recess and said outlet of the delivery slit, and having at the inner end a retaining head whose profile corresponds at least in part to the profile of said recess;

a support member applied to said extrusion head near the outlet of said delivery slit;

and a rotating bar carried by said support member outside said delivery slit near the outlet thereof, said rotating bar contacting said moving web opposite said support roller for spreading thereon the substance delivered by said outlet;

said rotating bar having its outer surface contacting in operative relationship said web only in register with those regions of the delivery slit which are free from limiting blade segments.

2. A device as set forth in claim 1, wherein the outer surface of said rotating bar is recessed in register with said limiting blade segments.

3. A device as set forth in claim 1, wherein said rotating bar extends only over part of the width of said extrusion head, in register with regions of the delivery slit which are free from limiting blade segments.

4. A device as set forth in claim 3, further comprising a connection bar coupled with one end of said rotating bar, and a centering pin cooperating with the other end of said rotating bar.

5. A device as set forth in claim 1, wherein said rotating bar has a single central portion of outer surface contacting in operative relationship said web, the end portions of said rotating bar being inactive, and said limiting blade segments are two in number and are inserted into the delivery slit from the opposite ends thereof, in register with the inactive end portions of said rotating bar.

6. A device as set forth in claim 2 wherein said rotating bar has a number of portions of outer surface contacting in operative relationship said web, said contacting portions being separated from each other by recessed surface portions, and said limiting blade segments are equal in number to, and are arranged in register with, said recessed portions of the outer surface of the rotating bar.

7. A device as set forth in claim 1, wherein said support member applied to the extrusion head comprises means for controlling the position of the rotating bar and for controllably inflecting the same.

8. A device as set forth in claim 7, further comprising means for controlling the thickness of the delivery slit without exerting any action on said rotating bar.

9. A device as set forth in claim 7, wherein said support member applied to the extrusion head has a fixed portion rigid with the extrusion head, a movable portion carrying said rotating bar, a number of traction and thrust screws housed in said fixed portion and acting on said movable portion, and lock means for fixing said movable portion with respect to said fixed portion.

10. A device as set forth in claim 9, wherein said lock means comprise a number of brackets and of locking screws acting on said brackets, regularly spaced along the entire width of the extrusion head.

11. A device as set forth in claim 1, wherein said extrusion head is arranged below said support roller.

12. A device as set forth in claim 11, wherein said delivery slit forms, with respect to a horizontal plane, an angle ranging from 15° to 45°.

13. A device as set forth in claim 11, wherein said delivery slit forms, with respect to a horizontal plane, an angle near to 30°.

14. A device as set forth in claim 9, wherein said extrusion head is arranged below said support roller, and said movable portion of the support member applied to the extrusion head has a shield plate slanting towards the bottom in order to discharge the substance delivered by the outlet of the delivery slit during work interruptions of the device.

* * * * *